US006092492A

United States Patent [19]

Kampichler et al.

[11] Patent Number: 6,092,492

[45] Date of Patent: Jul. 25, 2000

[54] VENTING DEVICE FOR THE CRANKCASE OF AN INTERNAL COMBUSTION ENGINE

[75] Inventors: Guenter Kampichler; Herbert Geier, both of Ruhstorf, Germany

[73] Assignee: Motorenfabrik Hatz GmbH & Co. KG, Ruhstorf, Germany

[21] Appl. No.: 09/241,752

[22] Filed: Feb. 1, 1999

Related U.S. Application Data

[63] Continuation of application No. PCT/EP97/04210, Aug. 1, 1997.

[30] Foreign Application Priority Data

Aug. 5, 1996 [DE] Germany ..... 196 31 654

[51] Int. Cl.[7] ..... F02F 9/02

[52] U.S. Cl. ..... 123/41.86

[58] Field of Search ..... 123/41.86, 572, 123/573, 574

[56] References Cited

U.S. PATENT DOCUMENTS

| | | | |
|---|---|---|---|
| 3,134,658 | 5/1964 | Ripley . | |
| 3,326,198 | 6/1967 | Jackson et al. . | |
| 3,754,538 | 8/1973 | Ephraim et al. | 123/41.86 |
| 4,501,234 | 2/1985 | Toki et al. | 123/41.86 |
| 4,581,068 | 4/1986 | Anno et al. | 123/41.86 |
| 4,602,595 | 7/1986 | Aoki et al. | 123/41.86 |
| 4,721,090 | 1/1988 | Kato | 123/41.86 |
| 5,497,755 | 3/1996 | Maloney . | |

FOREIGN PATENT DOCUMENTS

| | | |
|---|---|---|
| 11010 | 6/1956 | Germany . |
| 20 48 340 | 10/1970 | Germany . |
| 2535950 | 5/1983 | Germany . |
| 1531080 | 7/1996 | United Kingdom . |

*Primary Examiner*—Marguerite McMahon
*Attorney, Agent, or Firm*—Helfgott & Karas, PC.

[57] ABSTRACT

A venting device, with a vent valve (2), for the crankcase (1) of an internal combustion engine, especially for a one-cylinder diesel engine, is provided with a duct (9) for the gas-oil mixture downstream from the vent valve (2) in flow direction, said duct ending in an oil trap (3), a connection (4) via which the gas can reach the atmosphere being provided downstream from the oil trap (3).

10 Claims, 2 Drawing Sheets

VENTING DEVICE FOR THE CRANKCASE OF AN INTERNAL COMBUSTION ENGINE

Figure 1:
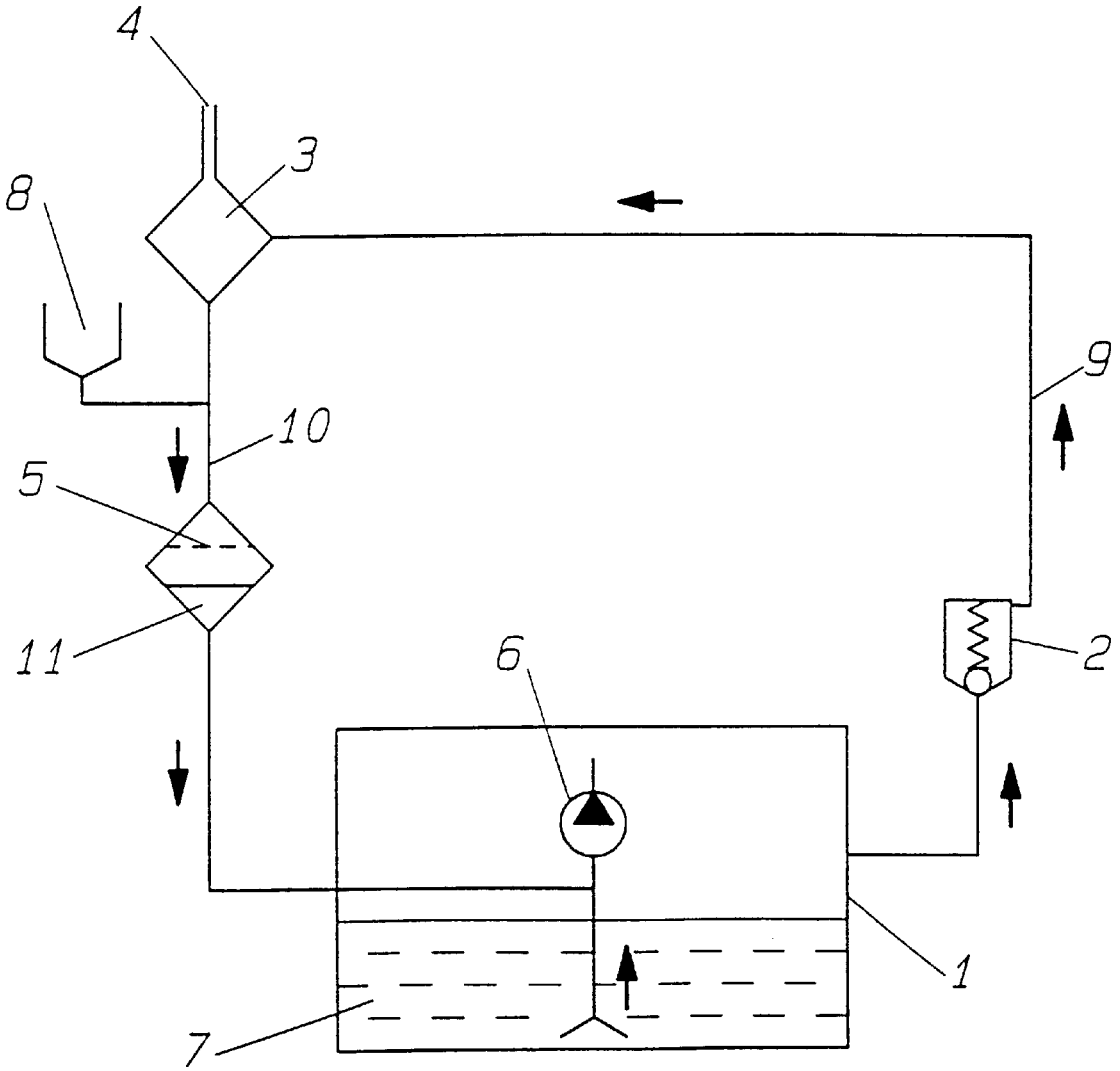

This application is a continuation of PCT/EP97/04210 filed Aug. 1, 1997.

The invention relates to a venting device, with a vent valve, for the crankcase of an internal combustion engine, especially for a one-cylinder diesel engine.

In such venting devices already known from the prior art, venting of the crankcase usually takes place via a line into the intake duct. This is certainly a nonpolluting method, since the oil liberated during venting is immediately burned in the combustion chamber. The disadvantage lies in the fact that, in the case of engines having severely inclined orientations, such as ship's engines or engines that have been overturned, the danger exists that the oil will pass into the combustion chamber, causing the engine to "race" and thus self-destruct because of excessive speed.

The object of the present invention is therefore to provide a venting device which effectively prevents the oil present in the venting device from reaching the combustion chamber, even if the internal combustion engine is in severely inclined orientation or has been overturned.

This object is achieved according to the invention by a device having the features of claim 1.

The invention is characterized in that a duct for the gas-oil mixture is provided downstream from the vent valve in flow direction, said duct ending in an oil trap, a connection via which the gas can reach the atmosphere being provided downstream from the oil trap.

By discharging the combustible gas mixture to the atmosphere, the crankcase is effectively vented and delivery of the ignitable gas mixture into the combustion space is prevented.

Furthermore, an advantageous embodiment of the present invention provides that the liquid space of the oil trap is connected with a separator for removal of the oil. This separator is a small chamber in which the oil is collected.

In a further advantageous embodiment, there is provided a connection of the separator with the intake side of the oil pump to return the oil to the crankcase. Thereby almost no oil is lost during venting of the crankcase, since the oil is collected in the oil trap and returned to the oil circulation of the crankcase. The gaseous constituents escape to the atmosphere as already described.

A further advantageous embodiment of the present invention is characterized in that, for connection of the separator with the intake side of the oil pump, there is provided a duct whose cross section is smaller than that of the duct for the gas-air mixture. By virtue of the connection with the intake side of the oil pump there is ensured constant suction, which ensures reliable return of the oil to the crankcase regardless of engine orientation. Because of the small cross section of the tubular line, it is advantageously ensured that oil in particular is sucked in from the separator. Although residual air is sucked in at the same time, it is harmless for the system.

A further advantageous embodiment of the present invention provides that the oil trap has a gas-permeable absorbent pad to absorb the oil. Hereby reliable separation of gas and oil is ensured in surprisingly simple manner. The absorbent pad immediately sucks up the oil, thus preventing spattering of the oil. In addition, the absorbent pad performs the function of a dust filter, wherein contaminants are partly absorbed and partly deposited on the surface. Moreover, simple and cost-effective maintenance is ensured by replacing the absorbent pad.

In a further advantageous embodiment, the connection of the separator with the intake side of the oil pump is provided with a closable opening for replenishing oil during operation. This can be advantageous, for example, for replenishing oil during operation of a ship's diesel engine, since it is then not necessary to shut down the engine during long voyages.

Furthermore, an advantageous embodiment of the present invention provides that the oil trap is formed by a vertical tube with an oblique opening. Hereby there is provided a large discharge cross section for the gas mixture in the oil trap, thus ensuring trouble-free functioning of the oil trap.

In a further advantageous embodiment, the vertical tube is surrounded by a concentric jacket, which is provided at its top end with an opening to the atmosphere. This construction permits simple and inexpensive manufacture.

A particularly advantageous embodiment provides that the vertical tube forms, at the end of the oblique opening, a tip which can be stabbed into the absorbent pad, which is made of felt. On the one hand this additionally ensures that oil running along the inside wall of the tube is reliably sucked up by taking advantage of capillary forces, while on the other hand the use of felt ensures that the vertical tube can be stabbed easily into the absorbent pad. Moreover, the use of felt as the absorbent pad represents a simple and cost-effective design.

Finally, yet another advantageous embodiment provides that the connecting lines are disposed outside the engine housing. Thereby there is ensured cool routing of the line, thus preventing the line cross section from coking, or in other words keeping the line open.

Figure 2:
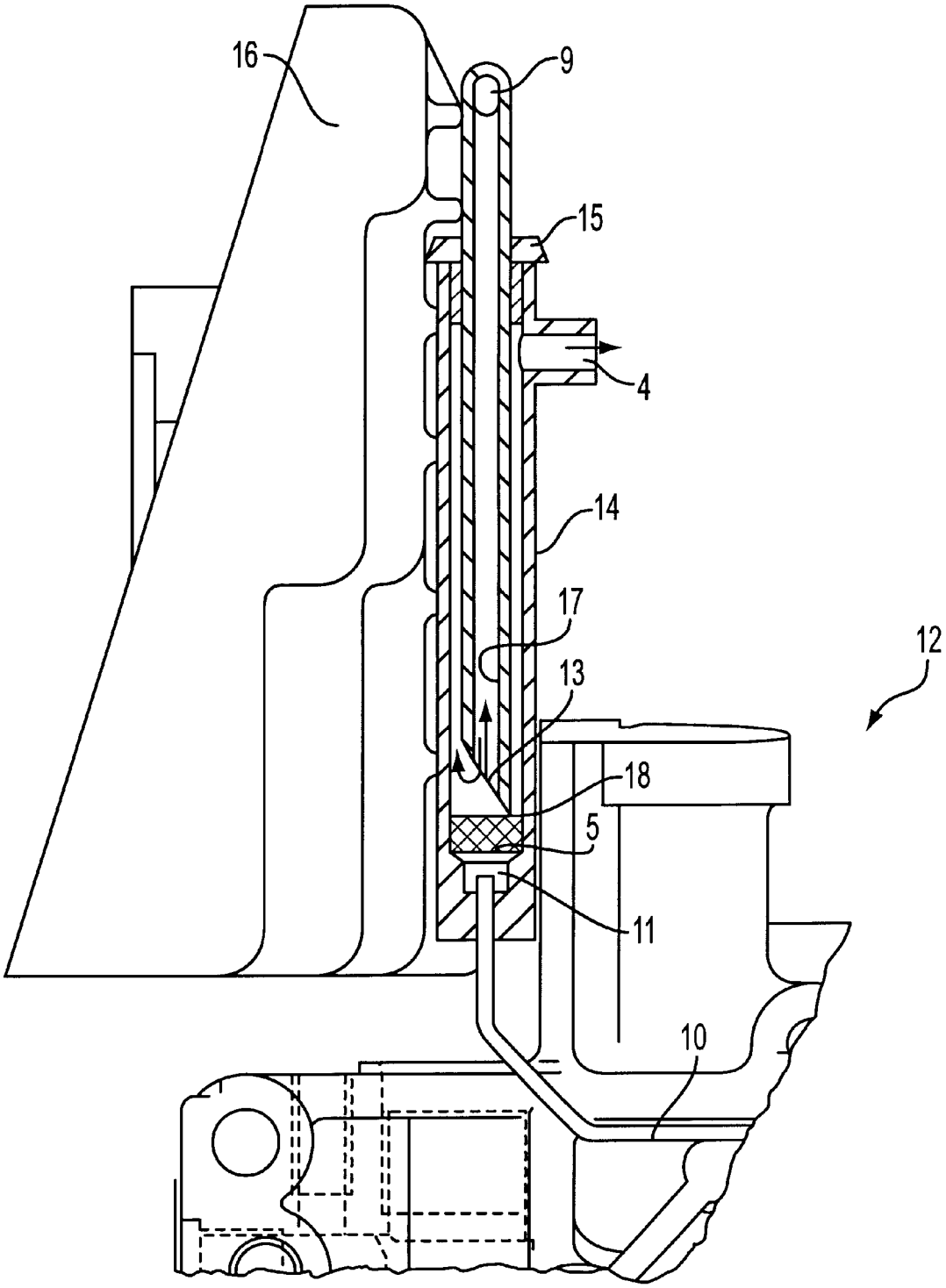

The present invention will be described hereinafter by means of a practical example in connection with the attached drawings, wherein FIG. 1 shows a schematic diagram of a venting device of the type according to the invention, FIG. 2 shows a sectional drawing of an oil trap of the type according to the invention.

In FIG. 1, the crankcase 1 is connected with a vent valve 2, which can be, for example, a diaphragm valve, the vent valve 2 being connected with an oil trap 3, which at one end is provided with an opening 4 to the atmosphere and at its other outlet is connected with a filter 5. The filter 5 in turn is connected with the intake side of the oil pump 6, which in turn sucks in the oil from an oil pan 7, and on its delivery side returns the oil to the crankcase 1. Between filter 5 and pump 6 there is additionally illustrated a filler tube 8, in which oil can be additionally supplied to the system.

When overpressure prevails in the crankcase, the gas-oil mixture can escape through vent valve 2 into the guide duct 9 provided for the purpose. The gas is then separated from the oil in oil trap 3 and discharged through opening 4 to the atmosphere, whereas the oil is sucked up by filter 5, which is designed as an absorbent pad. The oil filtered in this way passes from there into a small chamber, known as the separator 11. The oil collected therein is sucked in via the oil line 10 by the intake side of oil pump 6. This oil line 10 has a cross section of about 0.5 mm, which is substantially smaller than the cross section of line 9. Thus, if no oil is present in the separator, with the result that line 10 is drawing air, the quantity of air sucked in is thereby kept sufficiently small that the lubricating-oil system is not impaired (by detachment of lubricant, for example). From the intake side of the oil pump, which in the normal case sucks in oil from oil pan 7, the oil passes into crankcase 1. Filler tube 8 provides the capability of replenishing oil during operation.

FIG. 2 shows a section through the oil trap according to the invention. This is disposed outside the engine housing 12. Visible components are the guide duct 9 for the gas-oil mixture, the oblique opening 13, the gas-flow direction, indicated by arrow A, as well as the absorbent pad 5, the separator 11 and the oil line 10. Also illustrated are the jacket 14, the sealing closure 15 and the opening 4 to the atmosphere.

The oil trap is secured to the air-filter housing 16 by means of a retaining fixture. A gas-oil mixture from the crankcase passes through line 9 into the device. Because of the sharp reversal of air-flow direction shown by arrow A, the heavier oil particles slide downward along the vertical wall 17 and are sucked up by the absorbent pad 5, which is connected via the tip 18 with line 9. The air ascends in the jacket 14 and can escape to the atmosphere only through the opening 4. The oil collected and filtered in absorbent pad 5, which is made of felt, drips into a chamber 11, known as the separator, and is sucked in by the oil pump via oil line 10, which has much narrower diameter. Replacement of the absorbent pad for maintenance purposes can be achieved by taking off the sealing closure 15 and pulling out line 9.

We claim:

1. A venting device, with a vent valve, for the crankcase of an internal combustion engine, especially for a one-cylinder diesel engine, characterized in that a duct (9) for the gas-oil mixture is provided downstream from the vent valve (2) in flow direction, said duct ending in an oil trap (3), a connection (4) via which the gas can reach the atmosphere being provided downstream from the oil trap (3).

2. A venting device according to claim 1, characterized in that the liquid space of the oil trap (3) is connected with a separator (11) for removal of the oil.

3. A venting device according to claim 2, characterized in that there is provided a connection of the separator (11) with the intake side of the oil pump (6) to return the oil to the crankcase (1).

4. A venting device according to claim 3, characterized in that, for connection of the separator (11) with the intake side of the oil pump (6), there is provided a duct (10) whose cross section is smaller than that of the duct (9) for the gas-oil mixture.

5. A venting device according to claim 1, characterized in that the oil trap (3) has a gas-permeable absorbent pad (5) to absorb the oil.

6. A venting device according to claim 3, characterized in that the connection (10) of the separator (11) with the intake side of the oil pump (6) is provided with a closable opening (8) for replenishing oil during operation.

7. A venting device according to claim 1, characterized in that the oil trap (3) is formed by a vertical tube with an oblique opening (13).

8. A venting device according to claim 7, characterized in that the vertical tube is surrounded by a concentric jacket (14), which is provided at its top end with an opening (4) to the atmosphere.

9. A venting device according to claim 5, characterized in that the vertical tube forms, at the end of the oblique opening (13), a tip (18) which can be stabbed into the absorbent pad (5), which is made of felt.

10. A venting device according to claim 1, characterized in that the connecting lines (9, 10) are disposed outside the engine housing.

* * * * *